US007145518B2

(12) United States Patent
Tanaka et al.

(10) Patent No.: US 7,145,518 B2
(45) Date of Patent: Dec. 5, 2006

(54) MULTIPLE-FREQUENCY COMMON ANTENNA

(75) Inventors: Makoto Tanaka, Kariya (JP); Kazuoki Matsugatani, Kariya (JP); Hao Xin, Sherman Oaks, CA (US)

(73) Assignees: Denso Corporation, Kariya (JP); Rockwell Scientific Company, Thousand Oaks, CA (US)

( * ) Notice: Subject to any disclaimer, the term of this patent is extended or adjusted under 35 U.S.C. 154(b) by 9 days.

(21) Appl. No.: 10/673,336

(22) Filed: Sep. 30, 2003

(65) Prior Publication Data

US 2005/0068233 A1 Mar. 31, 2005

(51) Int. Cl.
*H01Q 15/02* (2006.01)
*H01Q 1/00* (2006.01)

(52) U.S. Cl. ..... 343/909; 343/700 MS; 343/853; 343/729; 343/829; 343/822; 343/846

(58) Field of Classification Search ..... 343/909, 343/700 MS, 756, 853, 822, 829, 846, 860, 343/729, 793, 789, 702
See application file for complete search history.

(56) References Cited

U.S. PATENT DOCUMENTS

| | | | | |
|---|---|---|---|---|
| 5,541,614 | A * | 7/1996 | Lam et al. | 343/792.5 |
| 5,831,557 | A * | 11/1998 | Handley | 341/67 |
| 5,923,225 | A * | 7/1999 | De Los Santos | 333/12 |
| 6,112,102 | A | 8/2000 | Zhinong | 455/552 |
| 6,262,495 | B1 * | 7/2001 | Yablonovitch et al. | 307/101 |
| 6,366,254 | B1 * | 4/2002 | Sievenpiper et al. | 343/770 |
| 6,433,756 | B1 * | 8/2002 | Sievenpiper et al. | 343/909 |
| 6,483,481 | B1 * | 11/2002 | Sievenpiper et al. | 343/909 |
| 6,545,647 | B1 * | 4/2003 | Sievenpiper et al. | 343/795 |
| 6,593,894 | B1 * | 7/2003 | Biswas et al. | 343/793 |
| 2003/0304113 | * | 10/2003 | Mokoto | 343/700 MS |
| 2005/0017919 | A1 * | 1/2005 | Sievenpiper et al. | 343/909 |
| 2005/0068233 | A1 * | 3/2005 | Tanaka et al. | 343/700 MS |

FOREIGN PATENT DOCUMENTS

| | | |
|---|---|---|
| JP | A-2000-59130 | 2/2000 |
| JP | A-2000-68736 | 3/2000 |

OTHER PUBLICATIONS

D. Sievenpiper et al., "Antennas on High-Impedance Ground Planes", *IEEE MTT-S Digest*, 0-7803-5135-5, 1999, pp. 1245-1248 (Discussed in p. 2 of the spec.), 1999.
D. Sievenpiper et al., "High-Impedance Electromagnetic Ground Planes", *IEEE MTT-Digest*, 0-7803-5135-5, 1999, pp. 1529-1532, 1999.

* cited by examiner

*Primary Examiner*—Hoang V. Nguyen
*Assistant Examiner*—Chuc Tran
(74) *Attorney, Agent, or Firm*—Posz Law Group, PLC

(57) ABSTRACT

A multiple-frequency common antenna has a first substrate sheet and a second substrate sheet respectively structured by an HIP consisting of a metal plate, small metal plates disposed in two dimensions and linear metal bars connecting these elements. The antenna restricts propagation of surface currents of the first and second frequency bands which are not overlapping with each other. An inverse L-shape antenna and a monopole antenna which are fed with a center conductor and an external conductor of the coaxial line respectively operate as the antenna on the first substrate sheet in the first frequency band and second frequency band. The second substrate sheet does not propagate the radiated wave of the monopole antenna, thereby avoiding unwanted re-radiation.

20 Claims, 16 Drawing Sheets

MULTIPLE-FREQUENCY COMMON ANTENNA

FIELD OF THE INVENTION

The present invention relates to a multiple-frequency common antenna which resonates at a plurality of frequencies and a communication apparatus utilizing the same multiple-frequency antenna.

BACKGROUND OF THE INVENTION

In recent years, the number of mobile radio terminals to be loaded to a mobile station, particularly, a vehicle station is increased with rapid progress thereof toward high level information systems. The terminals may be a GPS (Global Positioning System) receiver, mobile telephone system and ETC (electronic toll collection) communication system. In these radio terminals, different frequencies are respectively used to eliminate interference. Therefore, the radio terminals are required to have respective antennas which operate, that is, resonate in different frequencies.

Moreover, it is desirable that these antennas are installed at the area near the instrument panel of vehicle or on the vehicle chassis in which rather excellent radio wave propagation condition can be assured. Moreover, it is also requested to install the antenna within the instrument panel or within a rear view mirror in a vehicle compartment, considering the external appearance of vehicle, acquisition of sufficient visual field for driver and safe drive and operation for vehicle.

(1) It is difficult to install a plurality of antennas in the limited space within a vehicle. Particularly, since air-conditioner, various meters, air-bag apparatus, moreover, information terminal devices such as audio device and navigation device are provided within the instrument panel, it is very difficult to provide a space for installation of antennas.

(2) Cables of the same number as the number of radio terminals are required for connection between the radio terminal and antenna.

(3) Many metallic members exist within the instrument panel to form metal cabinets of various devices and vehicle body. The reflected waves from these metallic members and the direct wave radiated directly from the antenna are complicatedly interfere with each other and thereby many dead-band directions of radio waves. That is, many null points are formed and the antenna characteristics are worsened.

A multiple-frequency antenna covering a plurality of resonant frequencies has been developed as a means for solving the above problems (1) and (2). For example, JP-A-2000-68736 discloses an inverse F-antenna which is composed of three unit-radiation-conductors of different lengths arranged keeping the predetermined interval for operation in three frequency bands. Moreover, U.S. Pat. No. 6,112,102 (Japanese PCT Publication No. 2001-501412, WO 98/15028) discloses, as a multiple-frequency antenna in the other structure, a helical antenna combining two helical antennas of different pitches. Further, JP-A-2000-59130 discloses an antenna combining a linear conductor bar and a helical antenna. However, these multiple-frequency antennas of the prior art cannot solve the above problem (3).

The problem (3) arises, as is well known, when the direct wave radiated from a radiation element of the antenna interfere with the wave generated when a surface current flowing on the ground plane of the antenna is re-radiated from the end part of the ground plane.

U.S. Pat. No. 6,262,495 and the publication, "Antenna on High-Impedance Ground Planes, by D. Sievenpiper, et. al., IEEE MTT-S Digest, WEF1-1, 1245 (1999), disclose an antenna for solving the problem (3). That is, a ground plane called the high impedance ground plane (HIP) is used as shown in FIGS. 1A and 1B. In this HIP, hexagonal small metal plates 4 are periodically and two-dimensionally disposed on the surface of a dielectric material layer 3, and these metal plates 4 are coupled with a metal plate 2 at the rear surface of the dielectric material layer 3 and a through-hole 5 as a linear metal bar. Thus, a gap between the adjacent hexagonal small metal plates 4 forms a capacitance element. A current route of the end part of the hexagonal small metal plate 4→through-hole 5→metal plate 2→through-hole 5→end part of small metal plate 4 forms an inductance element. An LC parallel resonant circuit is formed with adjacent units consisting of these capacitance and inductance elements. A substrate having a higher impedance characteristic in the LC resonant frequency, that is, the HIP can be completed by forming many LC parallel resonant circuits on the metal plate 2.

The HIP can be thought of a kind of the photonic band gap material or the photonic band gap structure (PBG). PBG means a material or a structure in which a frequency region (called a band gap) which prohibits propagation of an electromagnetic wave of the particular frequency, that is, propagation of the surface current at the inside or on the surface by introducing the structure where two kinds of different substances such as dielectric material and metal are orderly arranged in two or three dimensions with the period in the order of wavelength. The band gap is formed in the particular structure for the electromagnetic wave of microwave band and light wave.

The above HIP is in the PBG structure corresponding to the electromagnetic wave covering from the microwave band to the millimeter wave band and has the following two characteristics.

One is that the electromagnetic waves entering the HIP are reflected in the same phase in the resonant frequency. These waves are reflected in the inverse phase in the case of the ordinary metal plate.

The other is that a surface current of the resonant frequency and the frequency element near this resonant frequency does not flow into the HIP.

The above IEEE publication shows the result of comparison of antenna characteristics when a monopole antenna of the same size is installed on a metal plate or on the HIP. That is, in the former case, since a surface current is generated, the direct wave and the wave radiated from the end part of the metal plate interferes with each other in the upper surface direction to generate a ripple in the directivity of antenna and a large amount of radiation in the lower surface direction can also be generated. On the other hand, in the latter case, since a surface current does not flow, radiation from the end part is never generated. Therefore, ripple in the directivity is not generated in the upper surface direction and radiation in the lower surface direction is also reduced.

As such, the above problem (3) can be solved by utilizing the HIP as the ground plane of antenna. However, this prior art cannot solve the above problems (1) and (2).

SUMMARY OF THE INVENTION

It is therefore an object of the present invention to provide a common or shared antenna which can control re-radiation of electromagnetic wave from the end part of a ground plane. Moreover, it is also an object of the present invention to provide an antenna which resonates in a plurality of frequency bands, realizes power feeding with only one power feeding line and controls re-radiation of the electromagnetic wave from the end part of the ground plane.

According to the present invention, a multiple-frequency common antenna comprises a substrate sheet having a band gap for prohibiting propagation of an electromagnetic wave on a surface in a particular frequency band. It also comprises a first antenna that resonates in a first frequency band within the band gap provided on the surface of the substrate sheet, and a second antenna that resonates in a second frequency band out of the band gap. Thus, the first antenna and the second antenna can operate in the different frequency bands. Further, the electromagnetic wave radiated from the first antenna does not flow as the surface current due to the band gap of the substrate, re-radiation of the electromagnetic wave from the periphery of the substrate and hence the directivity of the first antenna is not changed.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

The preferred embodiments of the present invention will be explained in detail with reference to various embodiments. Operations on an HIP of each antenna element used as a first antenna and a second antenna in the respective embodiments will be explained first.

<Monopole Antenna>

Figure 1A:
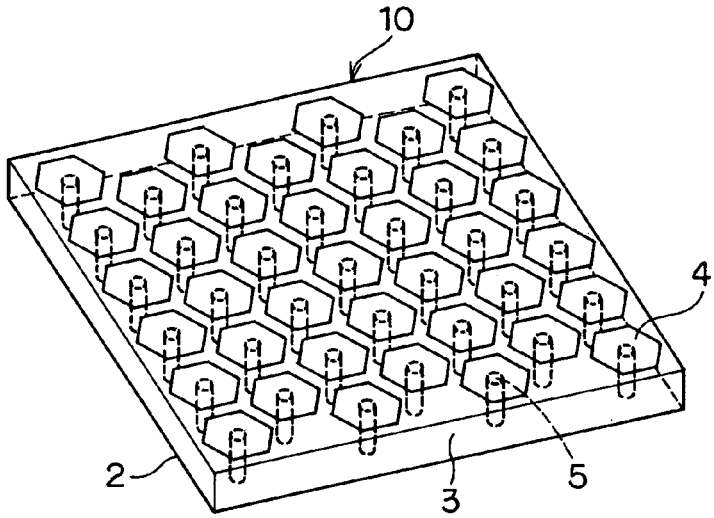
FIG. 1A PRIOR ART
FIG. 1A is a perspective view of a HIP (High Impedance Ground Plane) used as a substrate sheet of a multiple-frequency common antenna in the prior art.
Figure 1B:
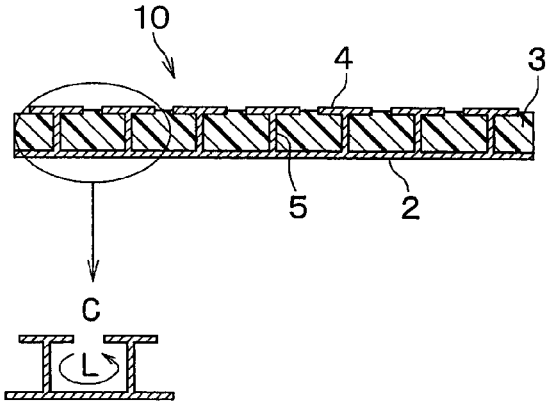
FIG. 1B PRIOR ART
FIG. 1B is a cross-sectional view of the HIP shown in FIG. 1A.
Figure 2:
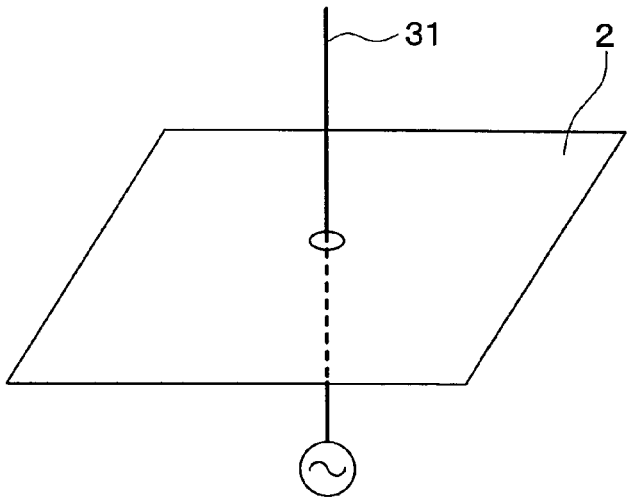
FIG. 2 is a perspective view of a mono-pole antenna.

An ordinary monopole antenna has a structure that a linear conductor bar 31 in the length of about quarter (¼) wavelength is erected on a metal plate 2 as shown in FIG. 2. A a power source is fed to a gap between this linear conductor bar 31 and the metal plate 2. Thereby, since a mirror image is formed when a surface current (plane current), that is, an image current flows into the metal plate 2, the directivity of the monopole antenna is expressed with the same shape as the upper half of that of a dipole antenna with the equivalent operation as the dipole antenna when a size of the metal plate 2 is infinitive.

However, on the HIP 10, an image current does not flow in the frequency band within the band gap thereof and thereby the mirror image is not formed and resonance of antenna does not occur. However, since a behavior of the HIP 10 in the frequency band out of the band gap is similar to that of the metal plate 2, the monopole antenna resonates, that is, operates as the antenna.

Figure 3:
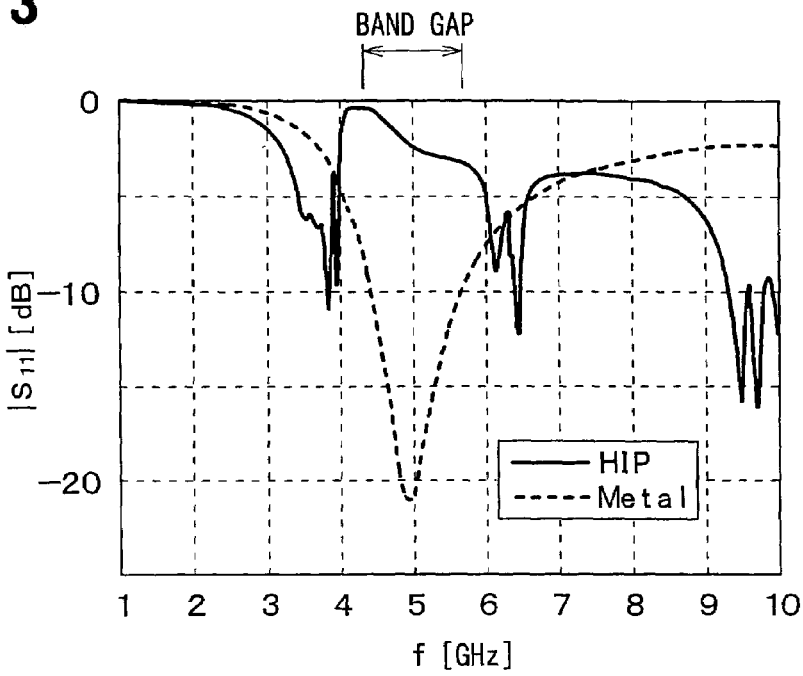
FIG. 3 is a graph showing actually measured values of return loss when the mono-pole antenna is installed on the HIP and a metal plate.
Figure 4:
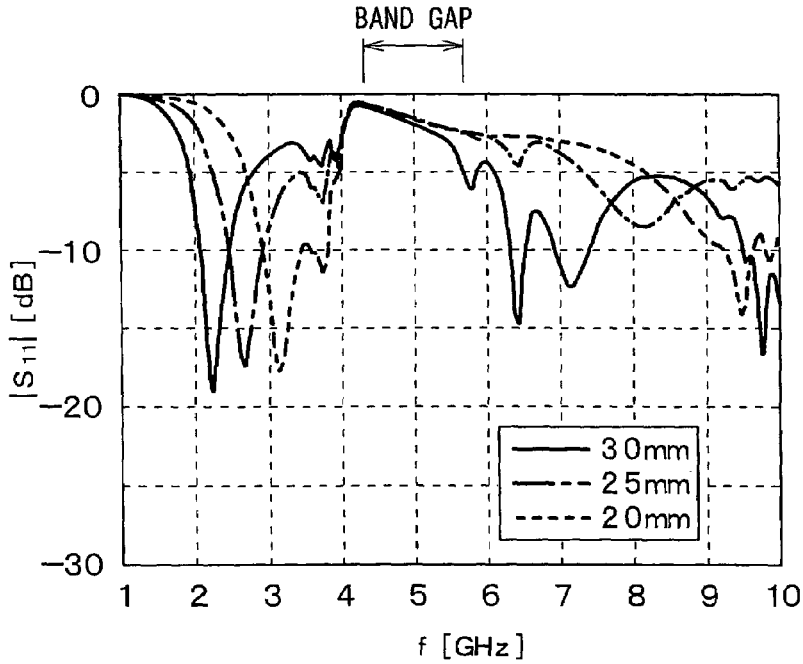
FIG. 4 is a diagram showing actually measured values of return loss when an element length of the mono-pole antenna installed on the HIP is varied.

These properties were confirmed with the experiments conducted by the inventors of the present invention. That is, as shown in the return loss characteristic of FIG. 3, it can be understood that the monopole antenna 31 which resonates at the frequency of 4.9 GHz for the metal plate 2 does not resonate in the HIP 10 having the band gap from 4.3 GHz to 5.7 GHz. Moreover, the return loss characteristic of FIG. 4 indicates the measured values when the length of the linear conductor bar 31 of the monopole antenna, that is, the element length is variously changed to 20 mm, 25 mm, 30 mm for the HIP. It can also be understood from this figure that the monopole antenna resonates at the frequency depending on the element length in the frequency band out of the band gap from 4.3 GHz to 5.7 GHz.

The monopole antenna installed on the HIP which resonates at the frequency band out of the band gap of the HIP is the second antenna in the following embodiments.

<Helical Antenna>

Figure 5:
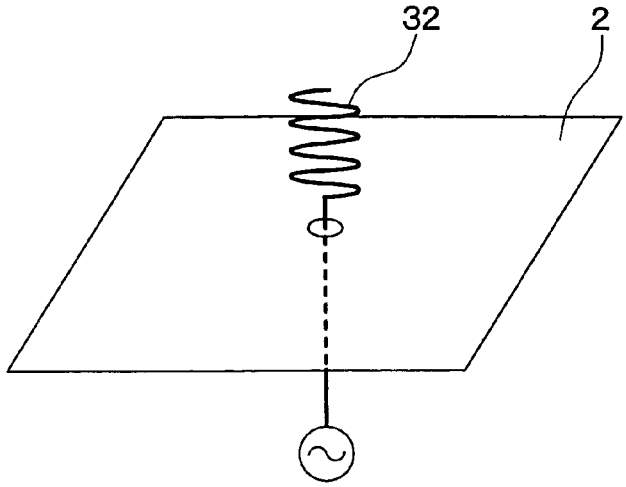
FIG. 5 is a perspective view of a helical antenna.

A helical antenna 32 may be thought to be formed in the spiral shape from the linear conductor bar of monopole antenna 31 as shown in FIG. 5. The basic operation thereof is similar to that of the monopole antenna 31 and does not operate as the antenna in the frequency band within the band gap of the HIP 10.

Figure 6:
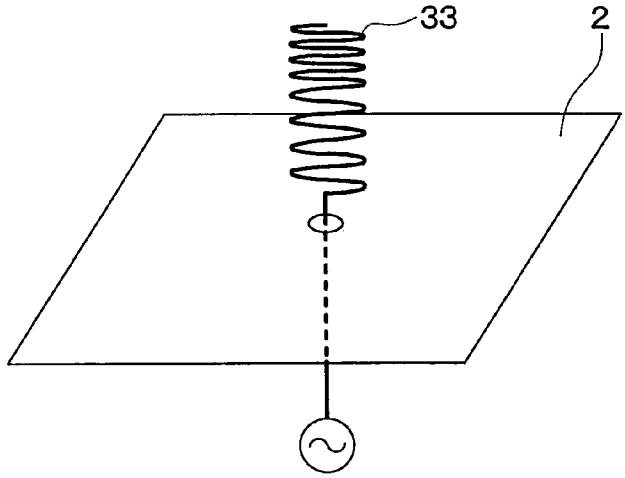
FIG. 6 is a perspective view of a non-uniform helical antenna.
Figure 7:
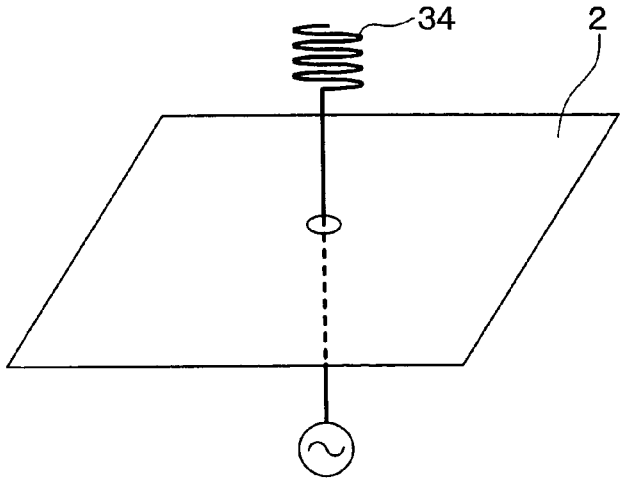
FIG. 7 is a perspective view of an antenna formed by combining a linear conductor and a spiral conductor.

Moreover, as a modification of this helical antenna, anon-uniform helical antenna 33 is shown in FIG. 6. In this helical antenna 33, the pitch of the spiral shape is changed in the course of the helical shape. As another modification, an antenna 34 is shown in FIG. 7. In this antenna 34, a linear conductor bar and a spiral conductor are cascade-connected. These modified helical antennas function as a 2-frequency common antenna only within the frequency band out of the band gap of the HIP 10.

The helical antenna and deformed helical antenna installed on the HIP which resonate in the frequency band out of the band gap of the HIP is the second antenna in the following embodiments.

<Inverse L-Shape Antenna>

Figure 8:
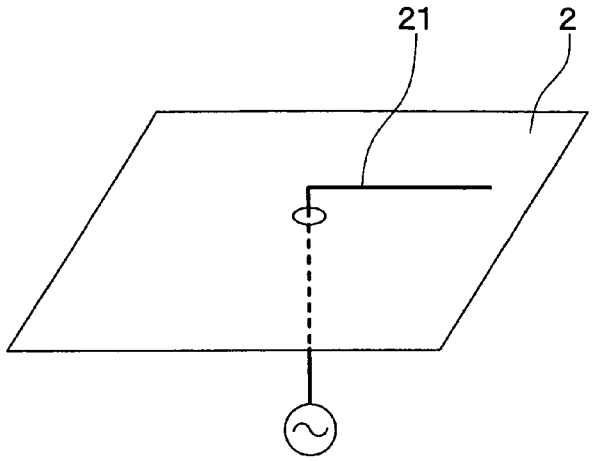
FIG. 8 is a perspective view of an inverse L-shape antenna.

An inverse L-shape antenna 21 is formed, as shown in FIG. 8, by folding the linear conductor bar of the monopole antenna 31 in the right angle in the course of the conductor. This antenna 21 operates differently from the monopole antenna. That is, when the inverse L-shape antenna 21 is installed on the metal plate 2, since an image current flows to the metal plate 2 in the direction opposed to a current of the folded linear conductor bar, these currents are cancelled with each other and thereby the antenna does not resonate. However, when this inverse L-shape antenna 21 is installed on the HIP 10, a surface current does not flow in the frequency band within the band gap, without canceling a current of the linear conductor bar. Accordingly, the inverse L-shape antenna 21 resonates as the antenna.

The inverse L-shape antenna installed on the HIP which resonates in the frequency band within the band gap of the HIP is the first antenna in the following embodiments.

<Hula-Hoop Type Antenna>

Figure 9:
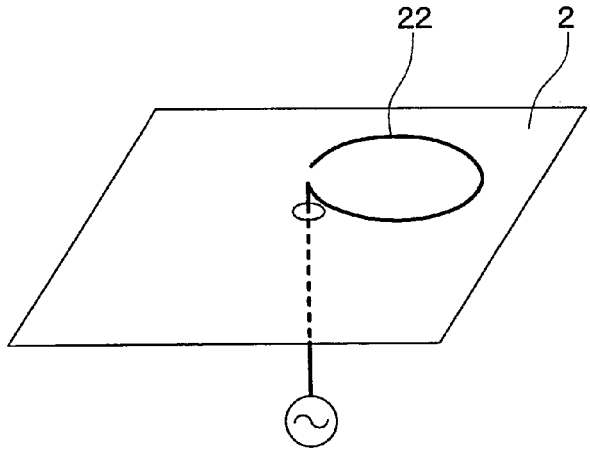
FIG. 9 is a perspective view of a hula-hoop type antenna.
Figure 10:
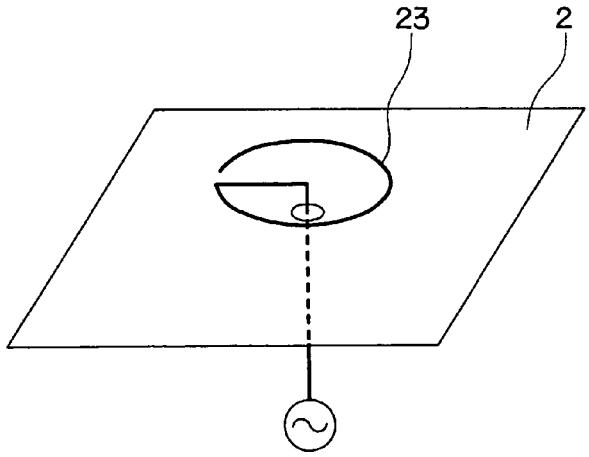
FIG. 10 is a perspective view of another hula-hoop type antenna.

As shown in FIG. 9 and FIG. 10, hula-hoop or ring type antennas 22 and 23 are formed in the manner that the entire part or only a part of the horizontally oriented conductor of the inverse L-shape antenna is formed as a circle within the horizontal plane. This hula-hoop type antenna is capable of radiating a circularly polarized wave. These hula-hoop type antennas 22 and 23 do not operate on the metal plate 2 like the inverse L-shape antenna 21 but resonate, on the HIP 10, as the antennas in the frequency band within the band gap.

The hula-hoop type antenna installed on the HIP to resonate in the frequency band within the band gap of this HIP is the first antenna in the following embodiments.

(First Embodiment)

Figure 11:
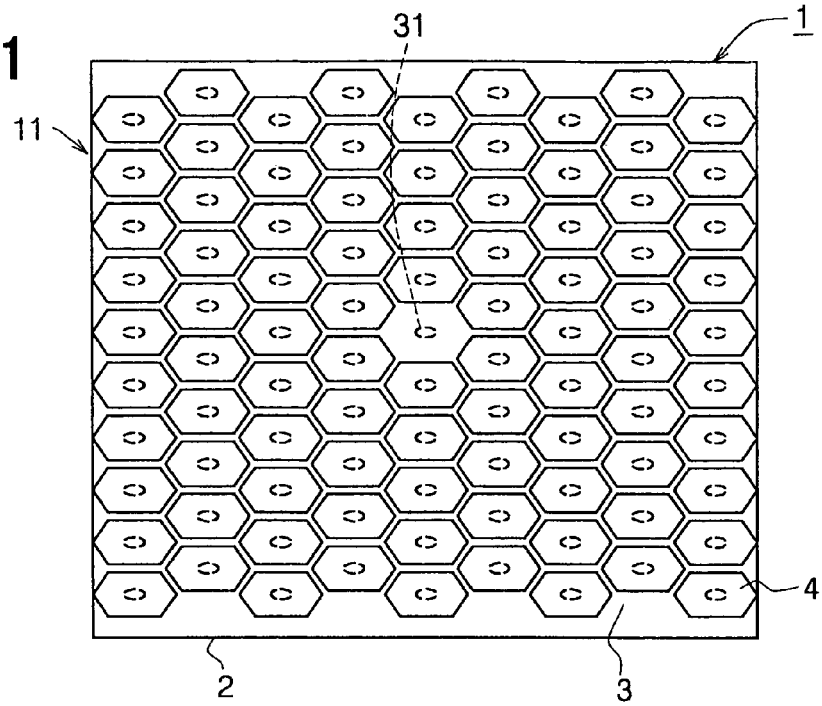
FIG. 11 is a plan view of a multiple-frequency common antenna according to the first embodiment of the present invention.
Figure 12:
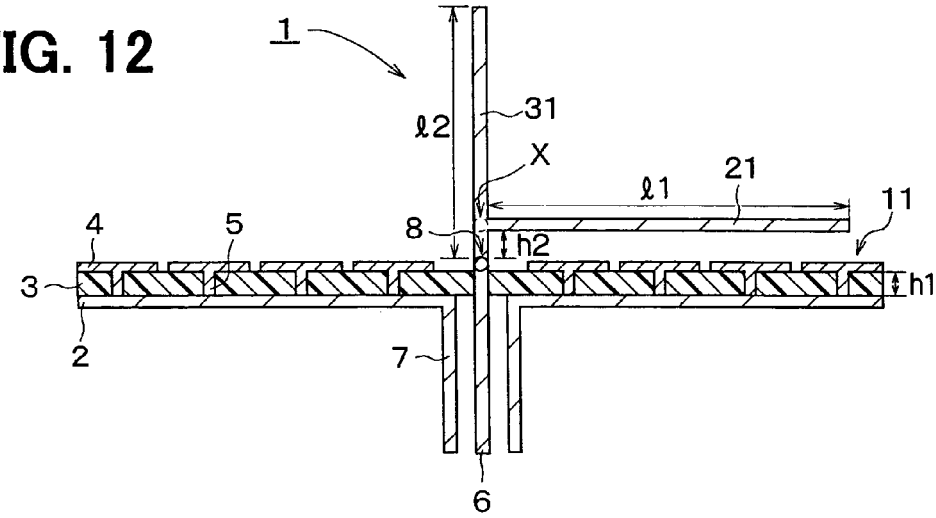
FIG. 12 is a cross-sectional view of the multiple-frequency common antenna according to the first embodiment.
Figure 13:
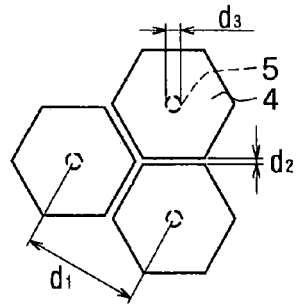
FIG. 13 is a diagram showing sizes of a small metal plate of the HIP used as the substrate sheet of the multiple-frequency common antenna according to the first embodiment.

A perspective view of a first embodiment of the present invention is shown in FIG. 11, while a cross-sectional view of the same is shown in FIG. 12. An HIP 11 used as a substrate sheet of a multiple-frequency common antenna 1 of the first embodiment is formed by disposing, as shown in FIG. 13, small hexagonal metal plates 4 in the pitch d1 of 7 mm and the gap between the plates d2 of 0.15 mm on a dielectric material layer 3 in the dielectric coefficient of 2.6 and the thickness h1 of 3.2 mm. These small metal plates 4 are connected with a metal plate forming the rear surface of the HIP 11 using through-holes 5 as the linear metal bars in the diameter d3 of 0.8 mm. In the structure explained above, the resonant frequency of the HIP 11 in this embodiment is set to 5 GHz. As the dielectric material layer 3, an air layer or a dielectric material substance other than the air may be used. As will be explained later, the geometry of HIP must be determined considering that when a capacitance element is increased using a substance having higher dielectric coefficient, the band gap frequency of the HIP is lowered.

Figure 14:
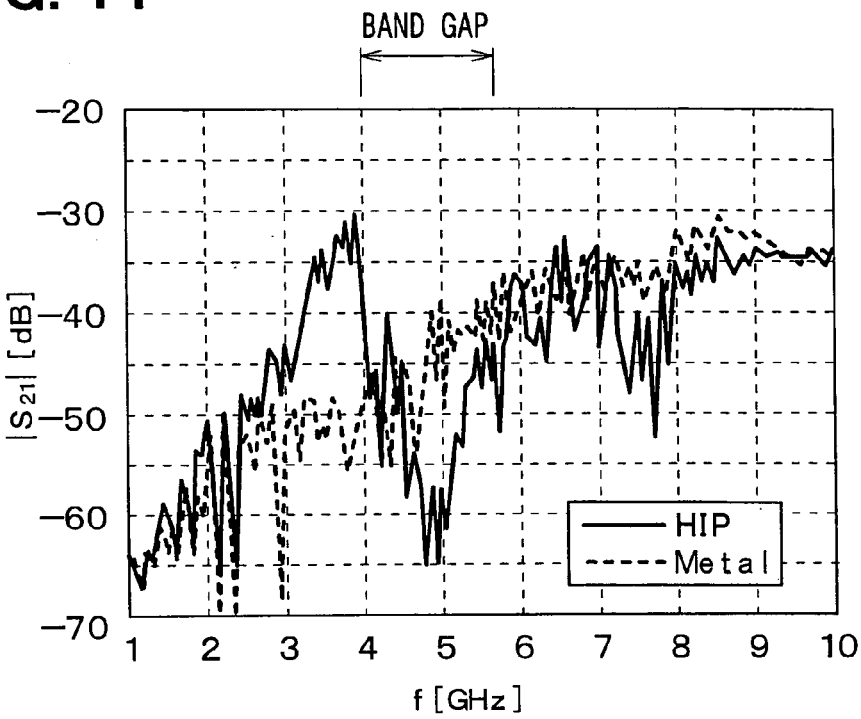
FIG. 14 is a graph showing measured values of a surface current of the HIP of the multiple-frequency common antenna according to the first embodiment.

FIG. 14 shows the result when the f-S21 characteristic as the measurement result of a surface current of the HIP 11 is compared with a surface current on a metal plate. From this figure, it can be understood that a band gap which does not allow flow of a surface current in the frequency band from 4 to 5.8 GHz is formed on the HIP 11.

The multiple-frequency common antenna 1 of this embodiment is formed, as shown in FIG. 12, by forming, on the HIP 11, radiation elements by connecting an inverse L-shape antenna 21 in the height h2 of 3 mm and element length l1 of 42 mm as the first antenna and a monopole antenna 31 in the length 12 of 28 mm as the second antenna at the branching point X. Power feeding to the radiation elements can be realized by connecting an external conductor 7 of a coaxial line and a metal plate 2 forming the rear surface of the HIP 11 and also connecting the center conductor 6 of the coaxial line and the radiation elements. Therefore, the power feeding point 8 corresponds to the position on the center conductor 6 of the coaxial line located upward from the metal plate 2 in the distance equal to the thickness of the dielectric material layer 3, that is, to the length of linear metal bar 5.

Since an image current which is required for resonance of the monopole antenna 31 does not flow into the HIP 11 in the first frequency band within the band gap which is formed by the HIP 11 used as the substrate sheet, the monopole antenna 31 as the second antenna does not operate. However, in the case of the inverse L-shape antenna 21, since an image current canceling a current flowing into the radiation elements does not flow, the inverse L-shape antenna 21 as the first antenna resonates. Accordingly, only the inverse L-shape antenna, that is, the first antenna operates in the first frequency band within the band gap of the HIP 11.

Meanwhile, the HIP 11 shows the equal property as an ordinary metal plate in the second frequency out of the band gap. Therefore, since an image current required for resonance of the monopole antenna 31 flows into the HIP 11, the monopole antenna 31 operates. However, since a current canceling a current flowing into the radiation elements flows in the inverse L-shape antenna 21, the inverse L-shape antenna as the first antenna does not operate. Accordingly, only the monopole antenna 31, that is, the second antenna operates in the second frequency band out of the band gap.

Figure 15:
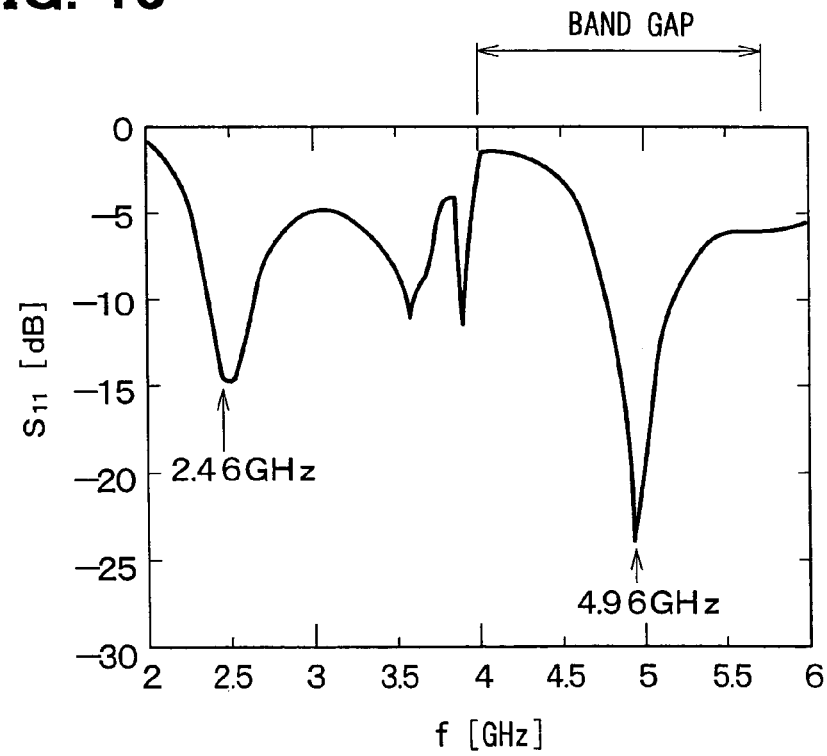
FIG. 15 is a graph showing actually measured values of return loss of the multiple-frequency common antenna according to the first embodiment.
Figure 16:
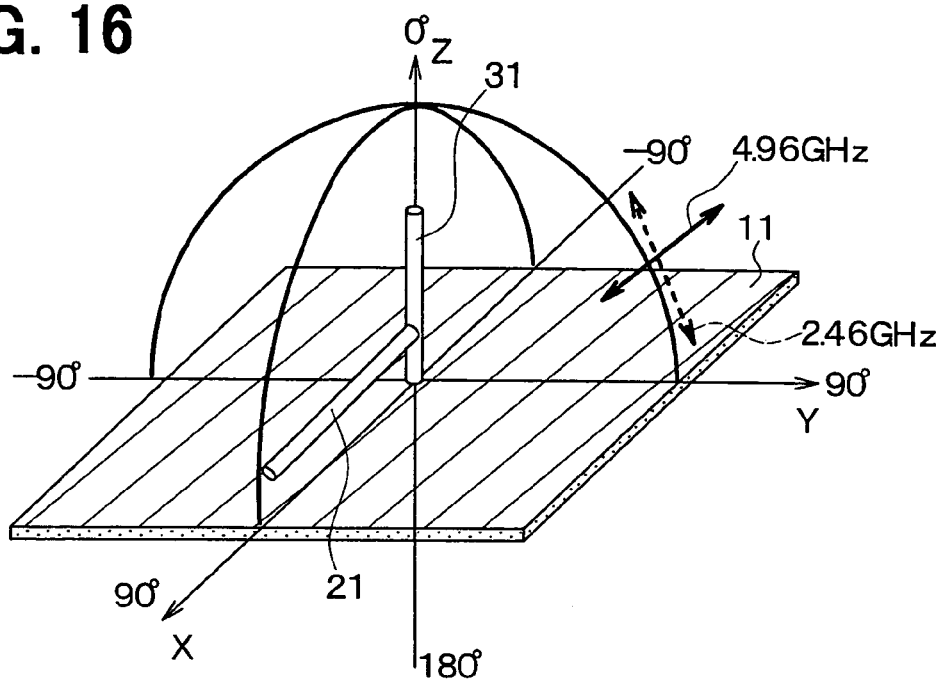
FIG. 16 is a schematic diagram showing a directivity measuring surface of the multiple-frequency common antenna according to the first embodiment.
Figure 17:
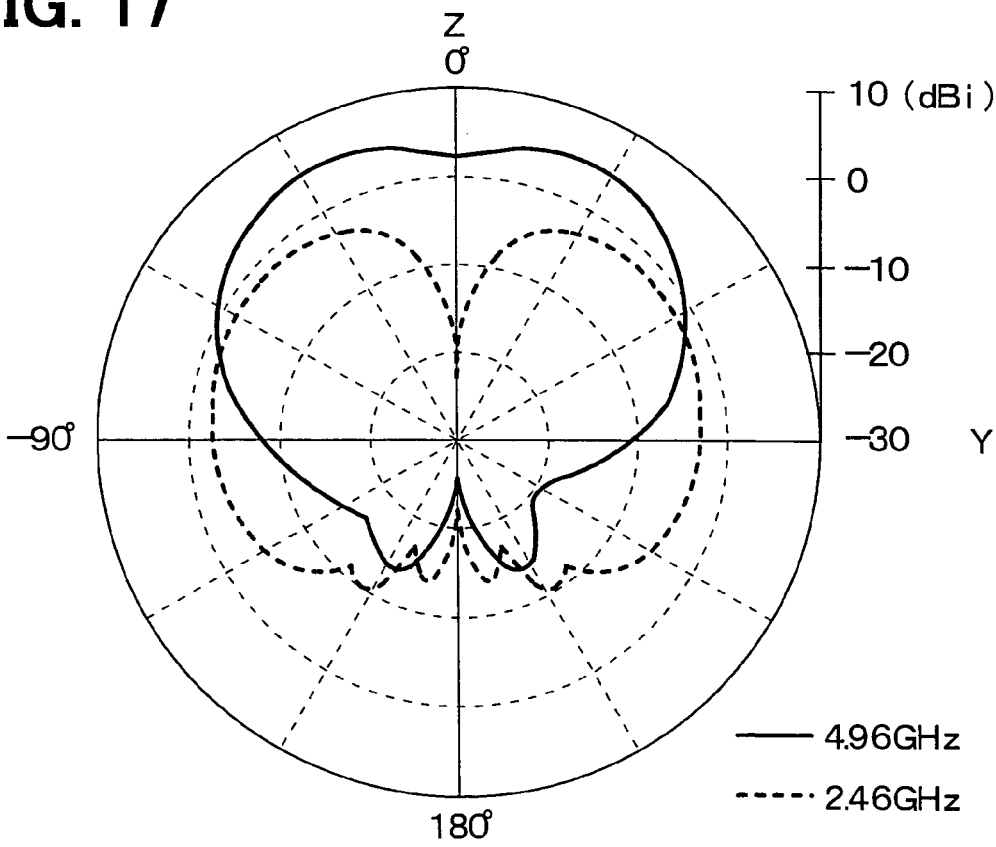
FIG. 17 is a graph showing measurement results of directivity of the multiple-frequency antenna according to the first embodiment.

FIG. 15 shows the measurement result of return loss of the multiple-frequency common antenna 1 of the first embodiment. From this figure, it can be understood that the monopole antenna 31 as the second antenna resonates in the frequency band outside of the band gap, that is, in the second frequency band from 2.46 GHz and the inverse L-shape antenna 21 as the first antenna resonates in the first frequency band within or inside the band gap, that is, in the first frequency band from 4.96 GHz. Thus, it is noted that the first frequency band is in a higher frequency side than the second frequency band. Moreover, FIG. 17 shows the measurement result of directivity of the antenna of this embodiment measured at the measuring plane shown in FIG. 16. Measurement of 2.46 GHz is conducted for the element parallel to the Y-Z plane and the result of this measurement is indicated with a dotted line as the directivity of the monopole antenna 31. Moreover, measurement of 4.96 GHz is conducted for the element vertical to the Y-Z plane and the result of this measurement is indicated with a solid line as the directivity of the inverse L-shape antenna 21. From FIG. 17, it can be understood that respective antennas resonate independently in each frequency.

The monopole antenna 31 can also be made to resonate in the frequency band higher than the band gap of above 4 to 5.8 GHz as the second frequency band by shortening the length of the radiation elements of the monopole antenna 31 than 28 mm.

(Second Embodiment)

Figure 18:
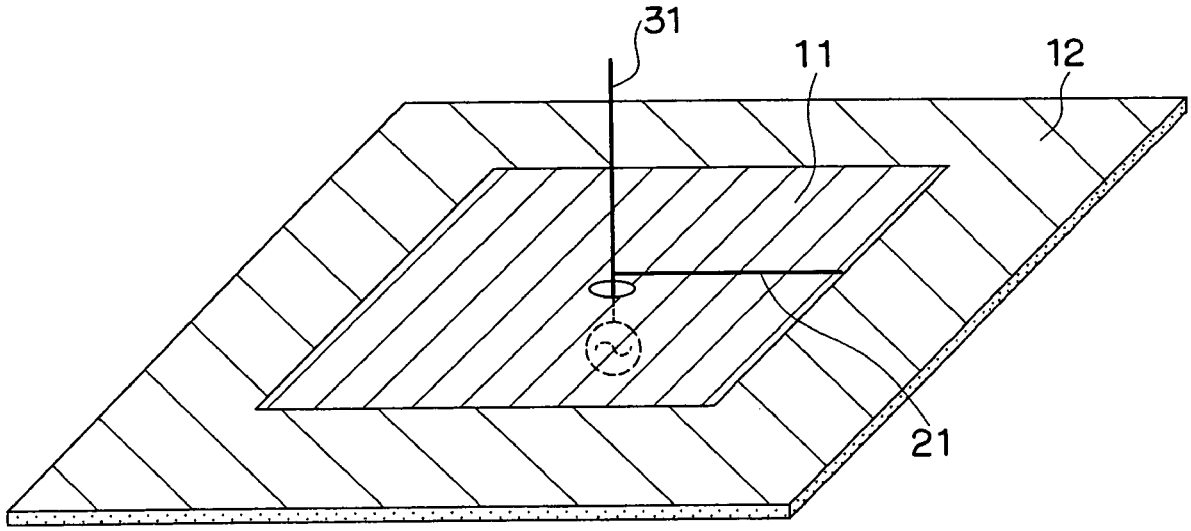
FIG. 18 is a perspective view of a multiple-frequency common antenna according to the second embodiment of the present invention.

FIG. 18 shows a perspective view of the multiple-frequency common antenna according to the second embodiment of the present invention. In FIG. 18 and the subsequent figures, the surface including the small metal plates 4 of the HIP are indicated as the hatched areas.

The multiple-frequency common antenna according to the second embodiment is provided, at the outer peripheral portion of a first substrate sheet 11, with the HIP as the first substrate sheet 11 which has also been used as the substrate sheet of the multiple-frequency common antenna in the first embodiment and the HIP as a second substrate sheet 12 in which the second frequency band including the resonant frequency of 2.46 GHz of the monopole antenna as the second antenna is defined as the frequency band from the band gap. However, the first frequency band and the second frequency band are set not to overlap with each other.

The band gap of the HIP used as the substrate sheet can be adjusted for reducing the resonant frequency by increasing an inductance L or a capacitance C of an LC parallel resonant circuit. Therefore, the following methods are combined for the adjustment.

(a) The frequency band from band gap can be lowered by increasing the composite capacitance C through combination of a plurality of capacitances C.

(b) The frequency band from band gap is lowered because the capacitance C increases when the dielectric constant of the dielectric material layer 3 is increased.

(c) When the thickness h1 of the dielectric material layer 3 is increased, the inductance L thereof increases and thereby the frequency band from the band gap is lowered.

(d) When the gap d2 between the small metal plates 4 is reduced, the capacitance C increases and thereby the frequency band from the band gap is lowered.

Figure 19:
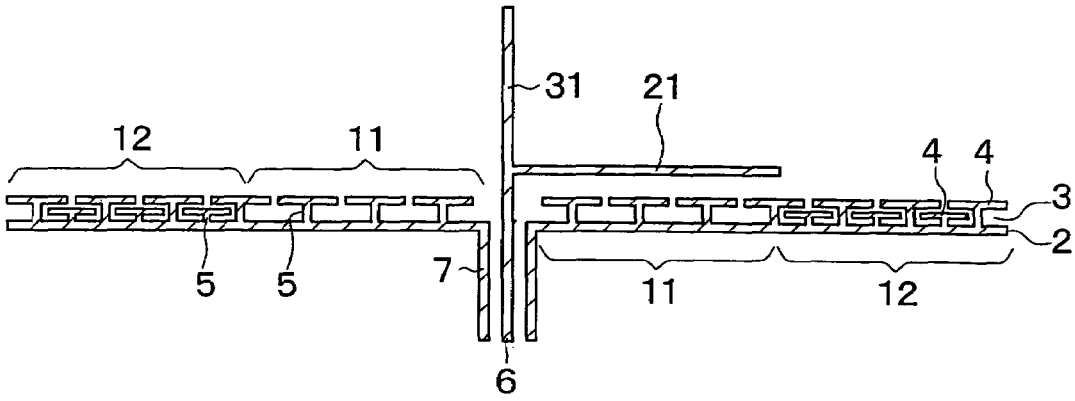
FIG. 19 is a cross-sectional view of the multiple-frequency common antenna according to the second embodiment.
Figure 20:
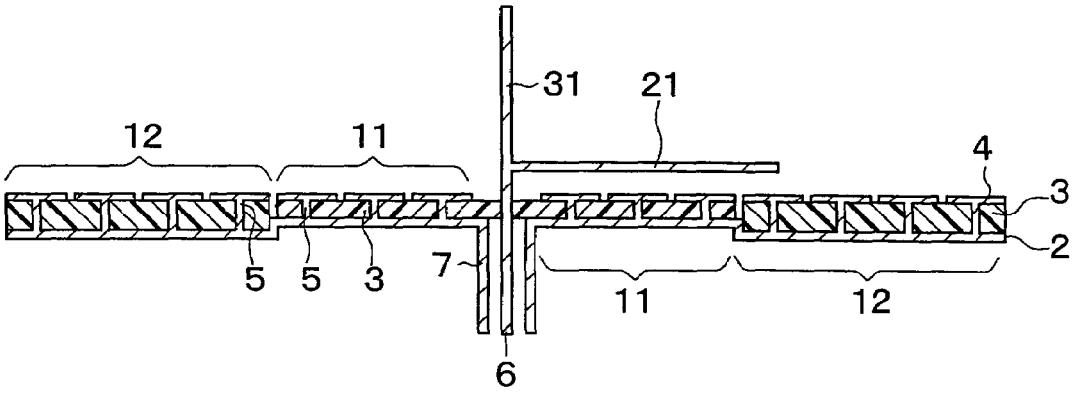
FIG. 20 is a cross-sectional view of another example of the multiple-frequency common antenna according to the second embodiment.

Therefore, in the second embodiment, the substrate sheet shown in FIG. 19 or FIG. 20 can be used. In the example of FIG. 19, the band gap frequency band from the HIP of the first substrate sheet 11 disposed to include the area near the power feeding point is set, like the first embodiment, to become the first frequency band including the resonant frequency of 4.96 GHz of the inverse L-shape antenna 21 as the first antenna. Moreover, the band gap frequency band from the HIP of the second substrate sheet 12 disposed at the outer peripheral portion of the first substrate sheet 11 is set, with the method (a), to become the second frequency band including the resonant frequency of 2.46 GHz of the monopole antenna 31 as the second antenna.

Moreover, in the example of FIG. 20, a stepped area is provided to the metal plate 2 of the substrate sheet and the thickness of the dielectric material layer of the second substrate sheet 12 is set thicker as much as the stepped area than the thickness of the dielectric material layer 3 of the first substrate sheet 11. When the dielectric coefficient of the dielectric material layer 3 is considered to be equal, the band gap frequency band from the HIP of the second substrate sheet 12 can be set lower than that of the first substrate sheet depending on the method (c). Moreover, when the dielectric coefficient of the dielectric material layer 3 of the second substrate sheet is set larger than that of the dielectric material layer 3 of the first substrate sheet 11, the band gap frequency band from the second substrate sheet 12 can be set to a lower value depending on the method (b).

Since the first frequency band not overlapping with the second frequency band is set as the band gap at the area near the power feeding point in the first substrate sheet 11, the inverse L-shape antenna as the first antenna which operates in the frequency band within the band gap of the first substrate sheet 11 and the monopole antenna 31 as the second antenna which operates in the second frequency band out of the band gap of the first substrate sheet 11 can be made to resonate simultaneously. In addition, since the second substrate sheet 12, in which the second frequency band not overlapping with the first frequency band is set as the band gap, is disposed at the outer peripheral portion of the first substrate sheet 11, a surface current in the second frequency band is rejected and the end part of the second substrate sheet 12 does not re-radiate the radio wave of the second antenna. Accordingly, formation of unwanted interference wave and formation of resultant null point can be prevented.

In each of the embodiments, an example where the band gap frequency band from the second substrate sheet 12 is set lower than the band gap frequency band from the first substrate sheet 11 is explained. The similar effect can also be obtained when the band gap frequency band from the second substrate sheet 12 is set, on the contrary, higher than the band gap frequency band from the first substrate sheet 11 through the design combining the methods (a) to (d).

Figure 21:
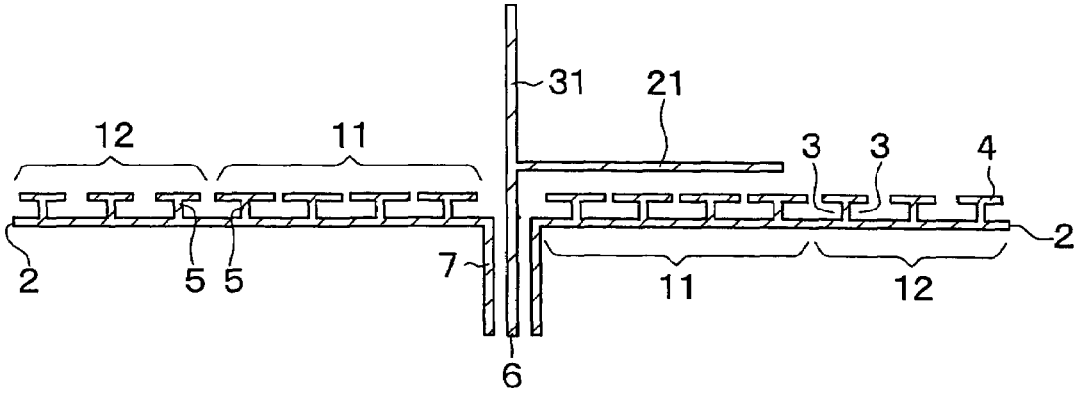
FIG. 21 is a cross-sectional view of the other example of the multiple-frequency common antenna according to the second embodiment.

That is, when the substrate sheet shown in FIG. 21 is used, the substrate sheet same as that of the first embodiment is used as the first substrate sheet 11 disposed to the area near the power feeding point and thereby the gap d2 between the small metal plates 4 of the second substrate sheet 12 disposed at the outer peripheral portion of the first substrate sheet 11 is set larger than that of the first substrate sheet 11. That is, the frequency band from the band gap can be set to a higher value with the method (d). In this case, since the second frequency band becomes higher than the first frequency band, the resonant frequency of the second antenna can be set to a higher value by shortening the element length of the monopole antenna 31. Here, the band gap frequency band from the second substrate sheet 12 can be set higher than the band gap frequency band from the first substrate sheet 11 by disposing alternately the internal and external substrate sheets in FIG. 19 and FIG. 20.

Figure 22:
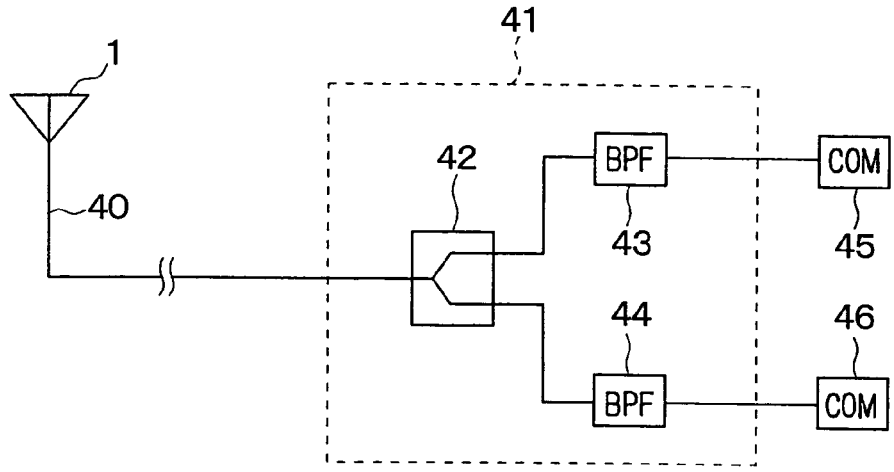
FIG. 22 is a circuit diagram showing a structure of a communication system using the multiple-frequency common antenna according to the second embodiment.

The second embodiment may be applied to a communication system, as shown in FIG. 22. A communication apparatus comprising a first communication circuit 45 operating in the first frequency band and a second communication circuit 46 operating in the second frequency band is connected to the two-frequency common antenna 1 of the second embodiment. An output signal of the two-frequency common antenna 1 is inputted to a signal separation circuit 41 via a single cable 40. In the signal separation circuit 41, an input signal is distributed to the identical signals with a power distributor 42 and these signals are inputted to the first communication circuit 45 and the second communication 46 via a first band-pass filter 43 which transmits the first frequency band and a second band-pass filter 44 which transmits the second frequency band.

In this embodiment, the multiple-frequency common antenna 1 is excited at one power feeding point and each radiation element thereof can be simultaneously resonated independently with difference frequencies. Consequently, an output signal thereof can be transmitted to the communication apparatus operating with a plurality of frequencies via a single cable. Thereby, connection between the antenna and communication apparatus can be simplified and weight of a vehicle can also be reduced effectively.

(Other Embodiments)

The radiation elements of the multiple-frequency common antenna may be constructed differently from the above embodiments as explained below.

Figure 23:
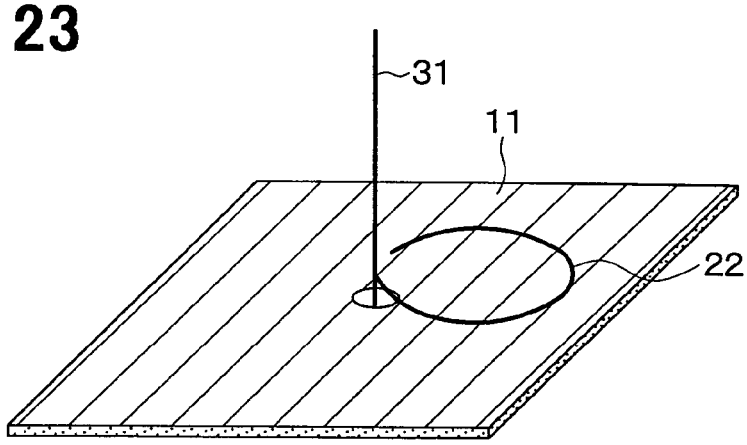
FIG. 23 is a perspective view of a multiple-frequency common antenna according to the other embodiment of the present invention.
Figure 24:
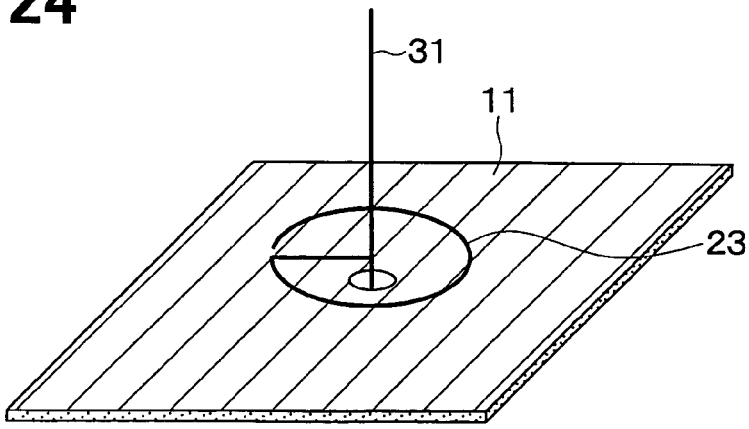
FIG. 24 is a perspective view of the multiple-frequency common antenna according to the other embodiment of the present invention.

(A) As the first antenna, a hula-hoop type antenna 22 or 23 which radiates the circularly polarized wave may be used in place of the inverse L-shape antenna 21 as shown in FIG. 23 and FIG. 24.

Figure 25:
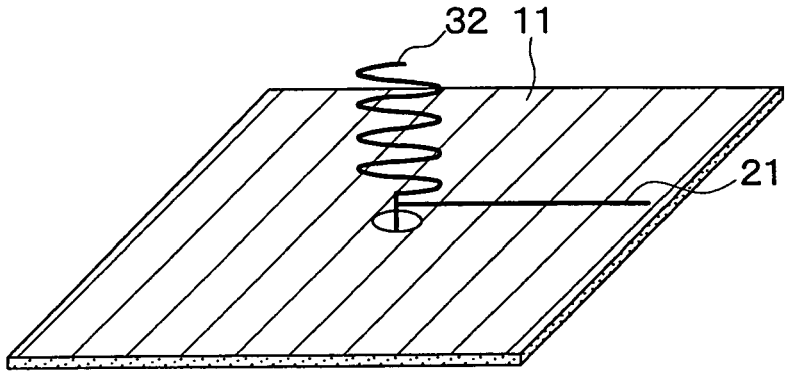
FIG. 25 is a perspective view of the multiple-frequency common antenna according to the other embodiment of the present invention.

(B) As the second antenna, a helical antenna 32 may be used in place of the monopole antenna 31 as shown in FIG. 25.

Figure 26:
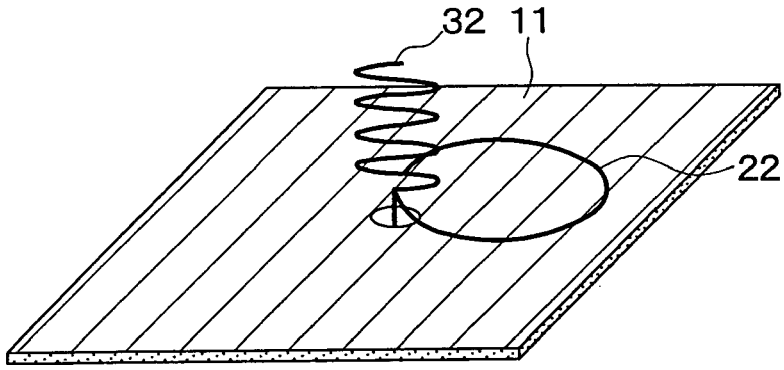
FIG. 26 is a perspective view of the multiple-frequency common antenna according to the other embodiment of the present invention.
Figure 27:
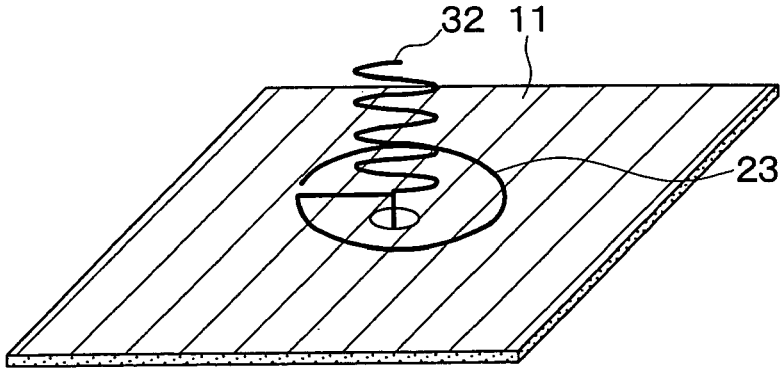
FIG. 27 is a perspective view of the multiple-frequency common antenna according to the other embodiment of the present invention.

(C) As the first antenna the helical antenna 32 may be used, and as the second antenna the hula-hoop type antenna 22 or 23 may be used as shown in FIG. 26 or FIG. 27, respectively.

Figure 28:
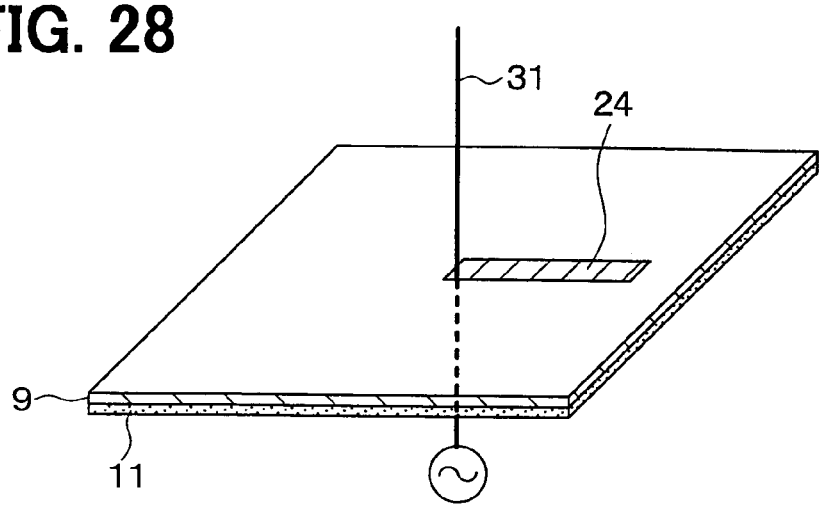
FIG. 28 is a perspective view of the multiple-frequency common antenna according to the other embodiment of the present invention.
Figure 29:
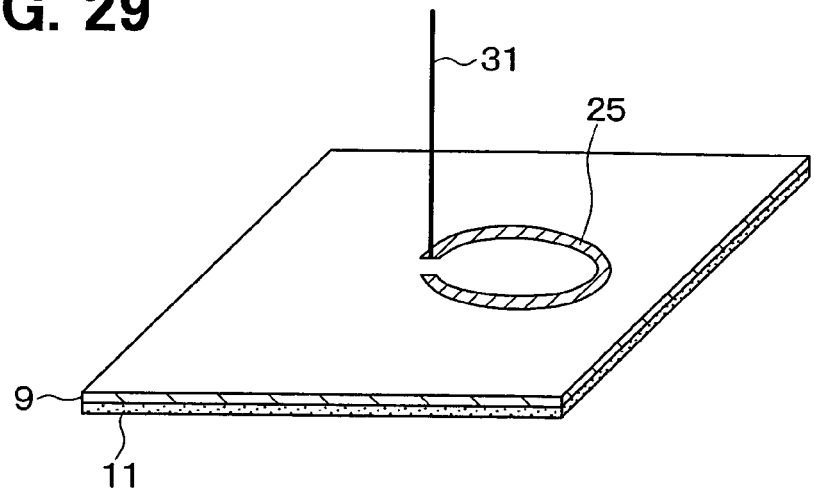
FIG. 29 is a perspective view of the multiple-frequency common antenna according to the other embodiment of the present invention.

(D) The respective radiation element 24 or 25 of the inverse L-shape antenna 21 and hula-hoop type antenna 22 or 23 as the first antenna may be formed, as shown in FIG. 28 and FIG. 29, at the surface of the dielectric material plate 9 of the constant thickness disposed on the surface of the substrate sheet 11. This radiation element 24 or 25 can be connected on the dielectric material plate 9 with the monopole antenna 31 or helical antenna 32 as the second antenna.

The radiation element 24 or 25 of the first antenna may be formed by placing a wire on the dielectric material plate and may also be formed by printing a metal film on the surface of the dielectric material plate 9. Thereby, an interval between the first antenna and the substrate sheet 11 can easily be maintained to a constant value for easily attaining the matching between antennas. Moreover, shape of the antenna is also less deformed even after a long period of use. In addition, higher processing accuracy can be attained easily in the formation of radiation elements with the printing process and therefore a small size radiation element for higher frequency can also be manufactured with higher accuracy.

Figure 30:
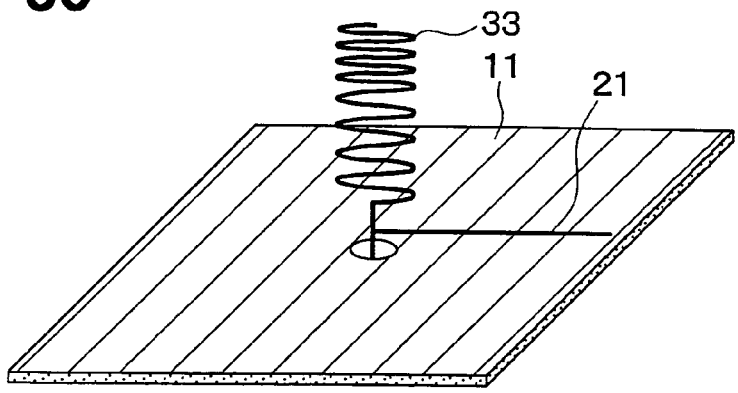
FIG. 30 is a perspective view of the multiple-frequency common antenna according to the other embodiment of the present invention.
Figure 31:
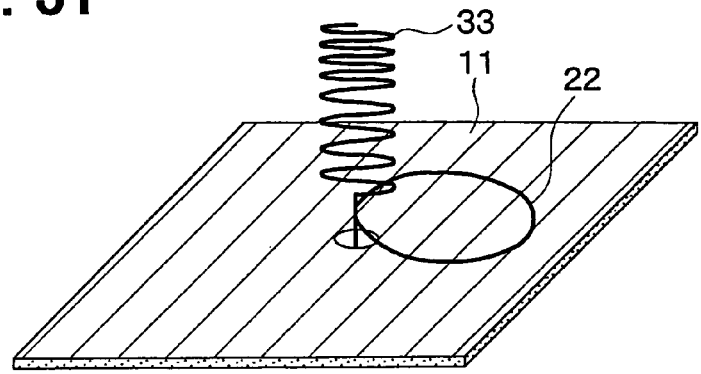
FIG. 31 is a perspective view of the multiple-frequency common antenna according to the other embodiment of the present invention.
Figure 32:
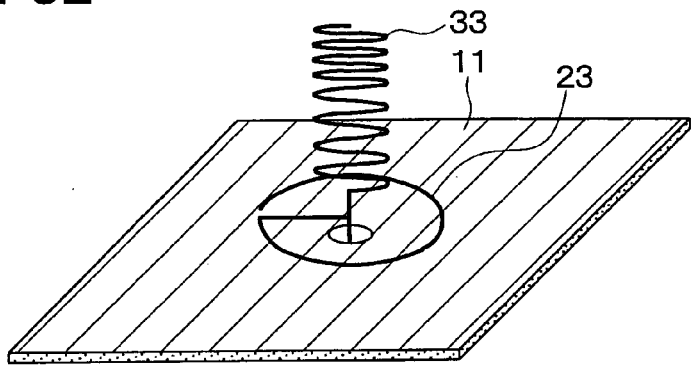
FIG. 32 is a perspective view of the multiple-frequency common antenna according to the other embodiment of the present invention.
Figure 33:
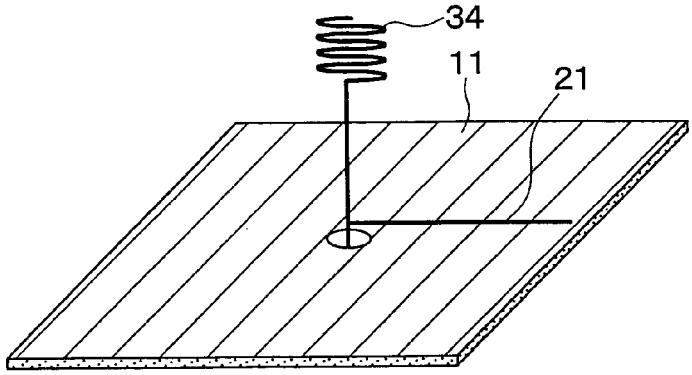
FIG. 33 is a perspective view of the multiple-frequency common antenna according to the other embodiment of the present invention.
Figure 34:
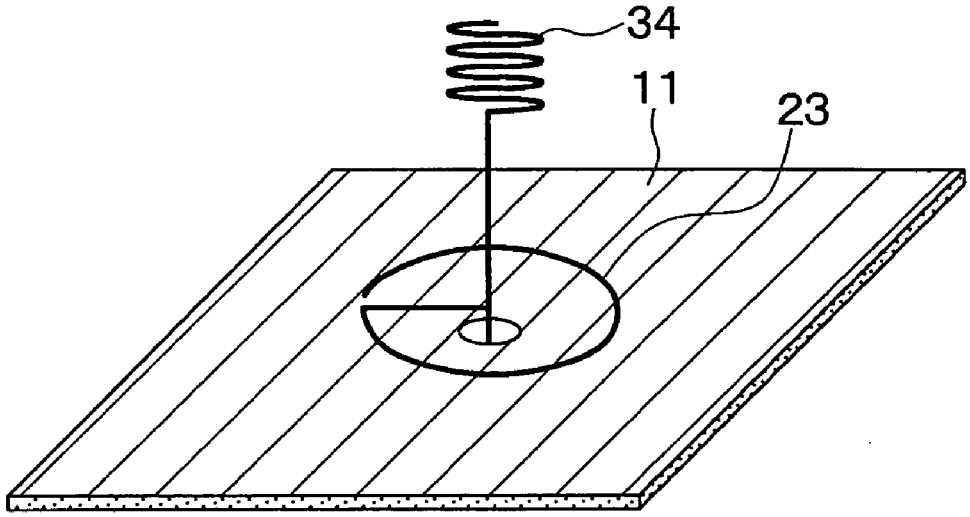
FIG. 34 is a perspective view of the multiple-frequency common antenna according to the other embodiment of the present invention.
Figure 35:
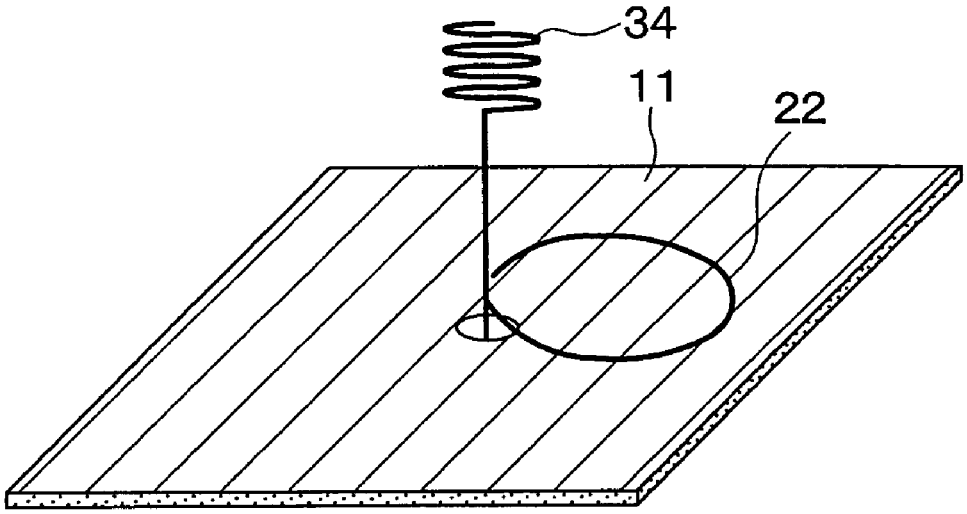
FIG. 35 is a perspective view of the multiple-frequency common antenna according to the other embodiment of the present invention.

(E) As the second antenna, the helical antenna 33 combining spiral conductors of different pitches as shown in FIG. 30 to FIG. 32 and the antenna 34 combining a linear conductor and a spiral conductor as shown in FIG. 33 to FIG. 35 may be used in place of the monopole antenna. Since the second antenna using these composite antennas can be used as the two-frequency common antennas, such antenna as a whole functions as the three-frequency common antenna.

In this three-frequency common antenna, when a couple of resonant frequencies of the second antenna exist within the band gap frequency band from the second substrate sheet, it is not required to change the second substrate sheet. However, if a couple of resonant frequencies of the second antenna are comparatively isolated and any one of resonant frequency is in the outside of the band gap frequency band from the second substrate sheet, it is preferable to form a three-layer structure in the plane direction by providing another second substrate sheet 13 to the outermost peripheral portion or between the first substrate sheet 11 and the second substrate sheet 12 in order to provide the band gap frequency band including the resonant frequency as shown in FIG. 36.

Figure 36:
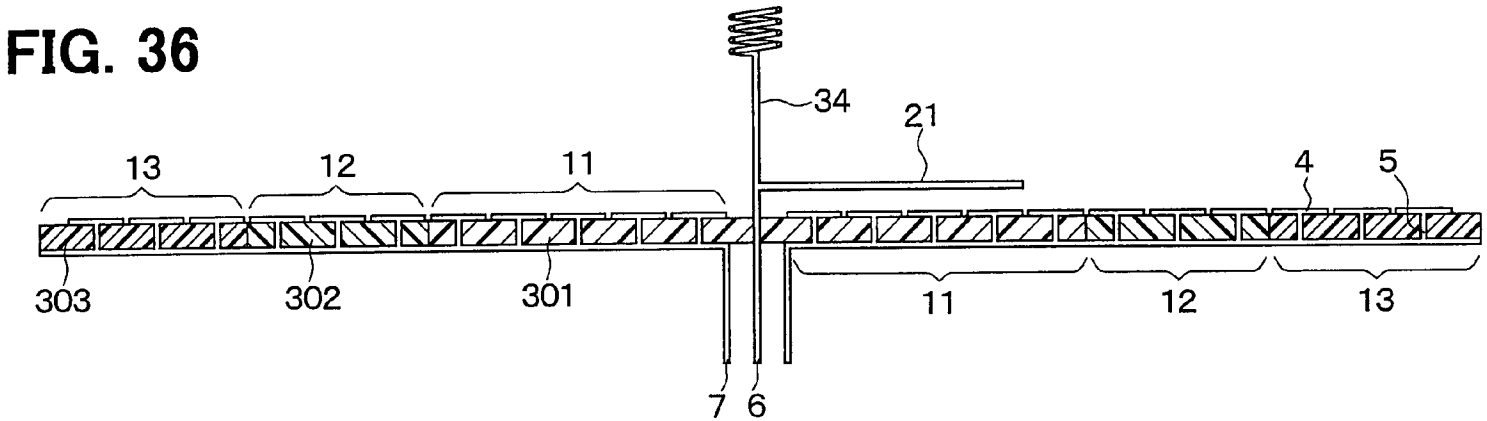
FIG. 36 is a cross-sectional view of a three-frequency common antenna according to the other embodiment of the present invention.

In the example of FIG. 36, the band gap frequencies of the substrate sheets 11, 12 and 13 are set to different values by selecting the dielectric material layers 3 of different dielectric coefficients for the first substrate layer 11 and two second substrate layers 12 and 13. Thereby, re-radiation from the end part of the substrate sheet can be prevented for the electromagnetic waves radiated from the second antenna of a couple of resonant frequencies.

Figure 37:
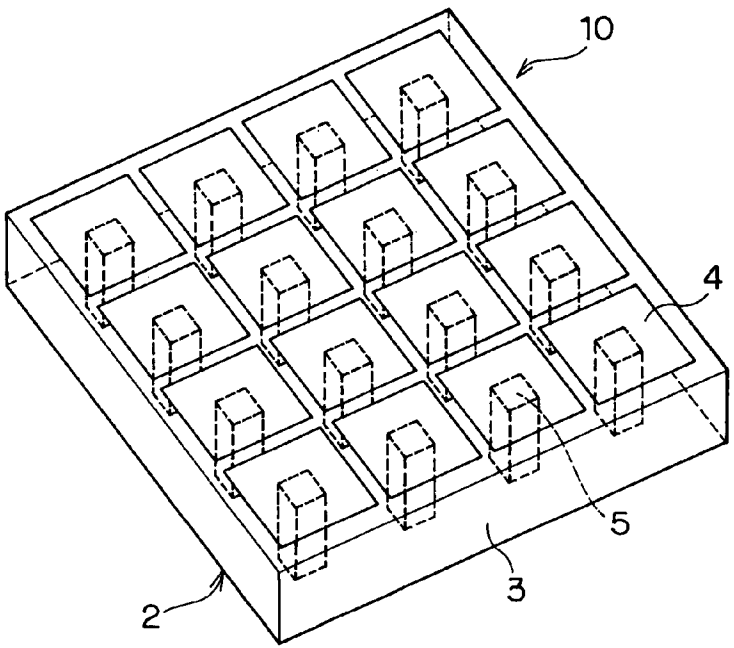
FIG. 37 is a perspective view of the HIP including small square metal plates according to the other embodiment of the present invention.
Figure 38:
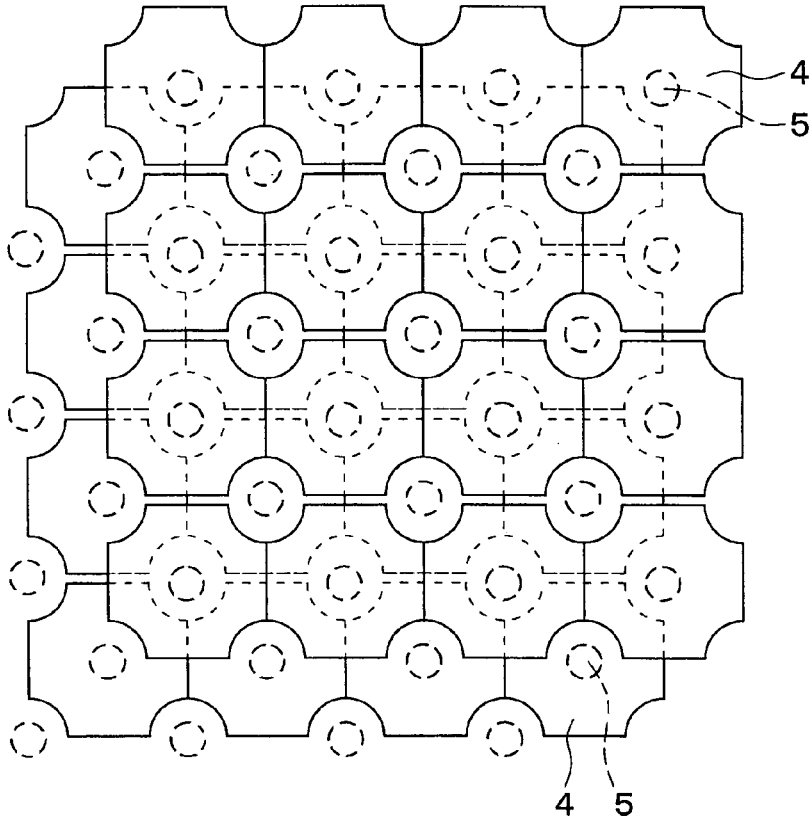
FIG. 38 is a plan view of the HIP including the double-layer structure of the small square metal plates of the other embodiment according to the present invention.

Shape of the small metal plates 4 forming the HIP is not limited to the hexagonal shape explained above and a square shape (FIG. 37) and various shapes (FIG. 38 and FIG. 39) such as double-layer structure of the square shape and hexagonal shape may be employed. In FIG. 37, the linear metal bars 5 are respectively disposed at the lattice points of the square shapes and each gap between the small metal plates 4 can be set equal by connecting the small square plates 4 and the metal plate 2 via the dielectric material layer 3. FIG. 38 is a plan view of the HIP where the small metal plates 4 of which apices of four corners are cut out are connected with the metal plate 2 with two kinds of linear metal bars 5 in different lengths disposed at two sets of lattice points having the apices at the gravity points thereof.

Figure 39:
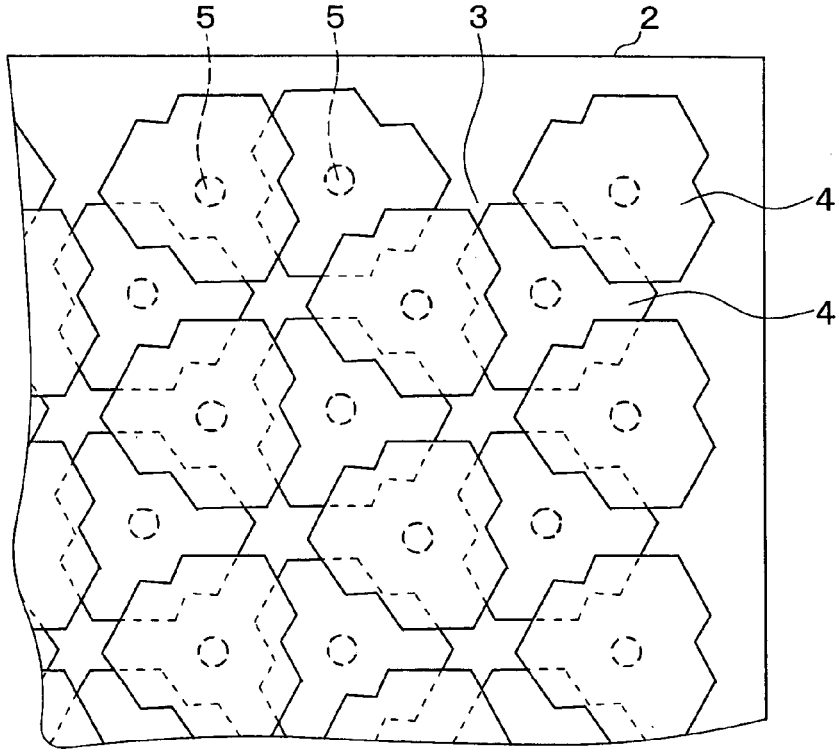
FIG. 39 is a plan view of the HIP including the double-layer structure of small hexagonal metal plates according to the other embodiment of the present invention.

Moreover, FIG. 39 is a plan view of the HIP where the small metal plates 4 of which apices of four corners are cut out are connected with the metal plate 2 with two kinds of linear metal bars 5 of different lengths disposed at the cut-out portions.

In any cases of FIG. 37 to FIG. 39, the band gap frequency band can be set by determining, based on the concepts (a) to (d), a capacitance C and an inductance L when the HIP is assumed as an LC parallel resonant circuit.

What is claimed is:

1. A multiple-frequency common antenna comprising:

a substrate sheet having a band gap for prohibiting propagation of an electromagnetic wave on a surface in a particular frequency band;

a first antenna for resonating in a first frequency band within the band gap that is provided on the surface of the substrate sheet; and a second antenna coupled to the first antenna at a connecting point, the second antenna for resonating in a second frequency band out of the band gap, wherein at least one of the first antenna and the second antenna is installed above the substrate sheet.

2. A multiple-frequency common antenna as in claim 1, wherein the substrate sheet comprises:

a conductor plate forming a rear surface of the substrate sheet;

a plurality of small metal plates of same shape disposed, to provide an equal interval for each end portion in two dimensions, on the surface of an dielectric material layer holding a dielectric material layer disposed on the conductor plate; and linear metal bars for electrically coupling the conductor plate and each small metal plate in the dielectric material layer, whereby the surface of each small metal plate arranged in two dimensions forms the surface of the substrate sheet.

3. A multiple-frequency common antenna as in claim 1, wherein the first antenna and the second antenna are coupled with a same power feeding line at an area near a power feeding point.

4. A multiple-frequency common antenna as in claim 1, wherein the first frequency band is in a higher frequency side than the second frequency band.

5. A multiple-frequency common antenna as in claim 1, wherein the first frequency band is in a lower frequency side than the second frequency band.

6. A multiple-frequency common antenna as in claim 1, wherein the first antenna is an inverse L-shape antenna.

7. A multiple-frequency common antenna as in claim 1, wherein the first antenna is a hula-hoop type antenna including a horizontal conductor which is parallel to the surface of the substrate sheet.

8. A multiple-frequency common antenna as in claim 1, further comprising:

a dielectric material plate disposed on the surface of the substrate sheet, wherein the first antenna is an element pattern formed on the surface opposing to the substrate sheet of the dielectric material plate.

9. A multiple-frequency common antenna as in claim 1, wherein the second antenna is a monopole antenna.

10. A multiple-frequency common antenna as in claim 1, wherein the second antenna is a helical antenna.

11. A multiple-frequency common antenna as in claim 1, wherein the second antenna is a non-uniform helical antenna having a plurality of different pitches.

12. A multiple-frequency common antenna as in claim 1, wherein the second antenna includes a linear conductor bar and a helical antenna which are cascade-connected to each other.

13. A multiple-frequency antenna as in claim 3, wherein the substrate sheet includes:

a first substrate sheet having the first frequency band as a band gap; and a second substrate sheet having a frequency band out of the first frequency band as a band gap, wherein the first substrate sheet is disposed in an area near the power feeding point and the second substrate sheet is disposed at an outer peripheral portion of the first substrate sheet.

14. A multiple-frequency common antenna as in claim 13, wherein the second substrate sheet has the second frequency band as a band gap.

15. A multiple-frequency common antenna as in claim 13, wherein a length of the linear metal bar of the first substrate sheet is different from that of the linear metal bar of the second substrate sheet.

16. A multiple-frequency common antenna as in claim 13, wherein a dielectric constant of dielectric material layer of the first substrate sheet is different from that of dielectric material layer of the second substrate sheet.

17. A multiple-frequency common antenna as in claim 13, wherein distance between end portions of small metal plates of the first substrate sheet is different from that between end portions of small metal plates of the second substrate sheet.

18. A multiple-frequency common antenna as in claim 1, wherein one of the first antenna and the second antenna is formed from a linear conductor bar attached to the substrate sheet.

19. A multiple-frequency common antenna as in claim 1, wherein both the first antenna and the second antenna are formed from a linear conductor bar attached to the substrate sheet, the linear conductor bar having a first portion associated with a first antenna and a second portion associated with a second antenna.

20. A multiple-frequency common antenna as in claim 1, wherein the first frequency band and the second frequency band do not overlap.

* * * * *